United States Patent [19]

Weingarten et al.

[11] Patent Number: 4,896,406

[45] **Date of Patent: * Jan. 30, 1990**

[54] METHOD FOR PRODUCING SHEETING PRODUCTS FROM YARN HAVING SHEATH AND CORE CONSTRUCTION

[75] Inventors: Jon Weingarten; Richard M. Altman, both of Weston, Conn.; Maura T. Buckley, Hoboken, N.J.; Kim L. Leipham, New York, N.Y.

[73] Assignee: Burlington Industries, Inc., Greensboro, N.C.

[ * ] Notice: The portion of the term of this patent subsequent to Dec. 8, 2004 has been disclaimed.

[21] Appl. No.: 328,782

[22] Filed: Mar. 27, 1989

Related U.S. Application Data

[63] Continuation of Ser. No. 191,764, May 3, 1988, abandoned, which is a continuation of Ser. No. 872,853, Jun. 11, 1986, abandoned.

[51] Int. Cl.[4] ..... D02G 3/00; D01H 5/28

[52] U.S. Cl. ..... 28/166; 57/12; 57/210

[58] Field of Search ..... 5/490, 495, DIG. 1; 57/12, 210, 313; 28/143, 166

[56] References Cited

U.S. PATENT DOCUMENTS

| | | | |
|---|---|---|---|
| 2,528,313 | 10/1950 | Kessler . | |
| 3,290,702 | 12/1966 | Seltzer . | |
| 3,365,872 | 1/1968 | Field, Jr. . | |
| 3,638,251 | 2/1972 | Weiss . | |
| 3,789,441 | 2/1974 | Weiss . | |
| 4,112,658 | 9/1978 | Morihashi . | |
| 4,191,221 | 3/1980 | Boyer | 57/210 X |
| 4,308,626 | 1/1982 | Weiss . | |
| 4,497,167 | 2/1985 | Nakahara et al. . | |
| 4,711,079 | 12/1987 | Newton et al. | 57/12 |

FOREIGN PATENT DOCUMENTS

| | | | |
|---|---|---|---|
| 114624 | 3/1936 | Belgium . | |
| 1201221 | 9/1965 | Fed. Rep. of Germany . | |
| 3303686 | 8/1983 | Fed. Rep. of Germany . | |
| 2310430 | 12/1976 | France . | |
| 52-74040 | 6/1977 | Japan | 57/12 |
| 53-35051 | 4/1978 | Japan | 57/210 |
| 55-51835 | 4/1980 | Japan | 57/12 |
| 60-181332 | 9/1985 | Japan | 57/210 |
| 61-11346 | 4/1986 | Japan | 57/210 |
| 435067 | 10/1967 | Switzerland . | |
| 636682 | 5/1950 | United Kingdom . | |

OTHER PUBLICATIONS

"Corcraft Products" flyer with article Easy Sheets–The Knitted Fitted Sheet Made With Bitech TM.

American Dyestuff Reporter, Jul. 18, 1955, "New Developments in Tricot Dyeing", by L. L. Walmsley.

*Primary Examiner*—Werner H. Schroeder
*Assistant Examiner*—Jodi Tokar
*Attorney, Agent, or Firm*—Nixon & Vanderhye

[57] ABSTRACT

A top bedsheet, bottom (fitted contour) bedsheet, or pillow case is produced by circularly knitting, in a jersey knit configuration, a sheath and core yarn into a fabric. The sheath fibers comprise short staple fibers such as cotton or comparable cellulosic fibers, and provide at least 50 percent of the yarn and preferably about 68–83 percent of the yarn. The core fibers are long staple synthetic fibers such as polyester, and are completely covered by the cotton so that the product has smoothness of hand. The fabric has a weight of approximately four ounces per square yard, and is finished so that it has a relaxed shrinkage of about five percent in both the length and width dimensions. The sheath and core yarn configuration is produced by passing a sliver of sheath fibers and a roving of core fibers through a trumpet, and then through the rear rolls, apron, and front rolls of a drafting apparatus to produce a drafted composite sliver, and then mechanically imparting a twist to the drafted composite sliver.

9 Claims, 2 Drawing Sheets

FIG. 4
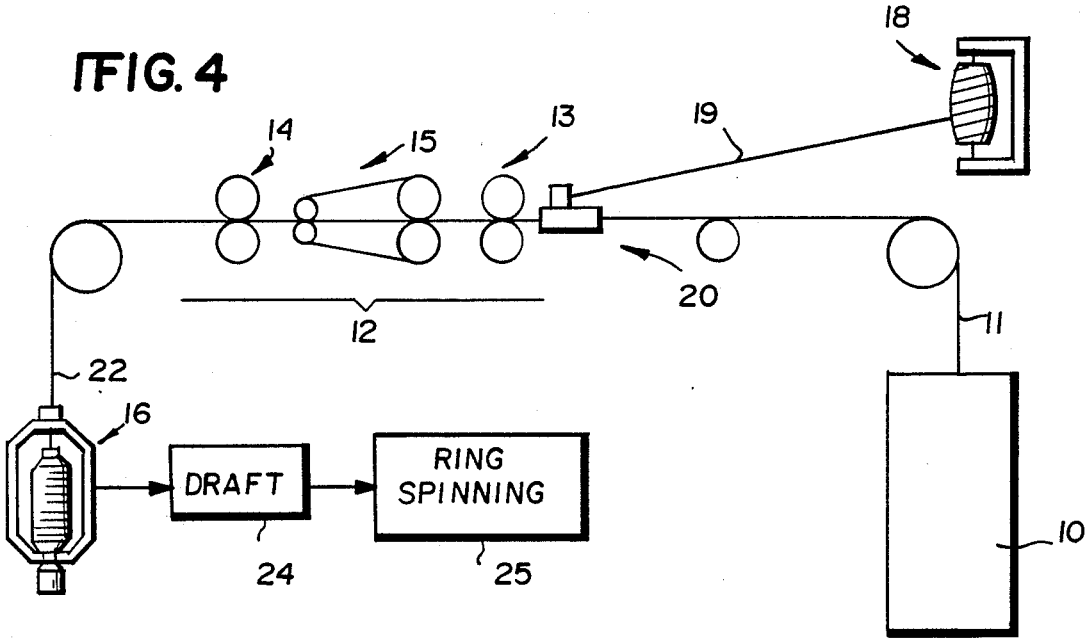
FIG. 5
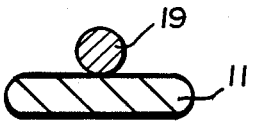
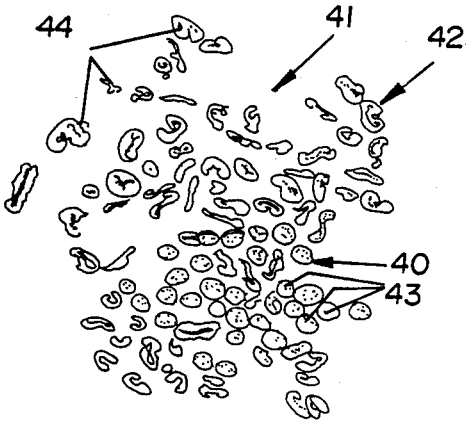
FIG. 7
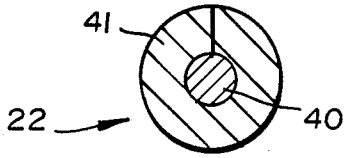
FIG. 6

METHOD FOR PRODUCING SHEETING PRODUCTS FROM YARN HAVING SHEATH AND CORE CONSTRUCTION

RELATED APPLICATIONS

This is a continuation of application Ser. No. 07/191,764 filed May 3, 1988, now abandoned which, in turn, is a continuation of application Ser. No. 06/872,853, filed June 11, 1986 and now abandoned.

BACKGROUND AND SUMMARY OF THE INVENTION

Traditional bedsheet products made from woven fabric constructions have several disadvantages. For instance, the bottom sheets oftentimes do not hold their fit position properly, and all of the bottom sheets, top sheets, and pillow cases have potentially harsh hand if optimum laundering procedures are not followed. Also, woven bedsheets prepared from cotton wrinkle easily unless provided with permanent press resin finish or unless constructed with a fairly high percentage of synthetic fiber yarn to provide a smooth appearance after washing. However the durable press resin finished sheets, and sheets made from conventional synthetic fiber blends, often have a harsh hand.

In order to overcome the problems associated with woven fabric constructions of bedsheets and pillow cases, sheets have been prepared—particularly fitted contour (bottom) sheets—from 100 percent cotton in a jersey knit construction, such as shown in U.S. Pat. No. 3,789,441. While such sheets solve the harsh hand problem, at least during early stages of their life, while having a no-iron construction, such sheets have problems of their own. For instance the 100 percent cotton fabric is weak, tears easily, absorbs and maintains moisture too readily, and often becomes harsh over time.

According to the present invention, a sheeting product is provided which overcomes the problems inherent in the prior art as discussed above. The invention relates to the construction of top sheets, bottom (fitted contour) sheets, and pillow cases which have numerous advantages compared to one or all of the prior art products discussed above. The invention relates to sheeting products, and a method of producing sheeting products, from a sheath and core yarn. The sheath fibers completely cover the core fibers, comprising more than 50 percent of the yarn, and preferably about 68–83 percent of the yarn. The sheath fibers are short staple fibers, such as cotton or cellulosic fibers having smoothness of hand properties comparable to cotton (when constructed into a fabric). The core fibers have properties distinctly different from the sheath fibers. Preferably the core fibers are long staple synthetic fibers, which have enhanced strength compared to the sheath fibers. The preferred core fiber is polyester, or synthetic polymer fibers that are comparable to polyester as far as strength, softness, and wicking properties are concerned.

The sheath and core yarn according to the present invention preferably is produced as set forth in co-pending application Ser. No. 824,788, filed Jan. 31, 1986 entitled "Roving Blending for Making Sheath/Core Spun Yarn" now U.S. Pat. No. 4,711,079 granted Dec. 8, 1987, the disclosure of which is hereby incorporated by reference herein.

In the practice of the present invention, the sheath-/core yarn is circular knit into a fabric, preferably into a jersey knit configuration on a conventional circular knitting machine. Typical fabric weight is about four ounces per square yard utilizing a yarn count of thirty two singles (32/1). The knit fabric is also preferably finished to give a relaxed shrinkage of about five percent in both the length and the width dimensions. The fabric is then formed into a top bedsheet, bottom bedsheet, or pillow case by conventional techniques.

The sheeting products according to the present invention have the following advantages compared to one or all prior art constructions discussed above: They have longer wear life than 100 percent cotton. They remain softer after repeated washing and tumble drying over a longer period of time. They absorb moisture more quickly and dry more quickly because the moisture is wicked through the polyester core from moist to dry areas, and during drying will return moisture from the wet core to the drying cotton sheath areas. Since a staple fiber core is provided, it is softer than comparable sheath and core yarns prepared with continuous filament synthetic cores. The product is stronger than 100 percent cotton knit sheeting, having better abrasion resistance, greater bursting strength, and greater tearing resistance. The sheeting according to the invention also has superior stretch and recovery properties compared with 100 percent cotton, is more wrinkle resistant with improved no-iron characteristics, and is more comfortable because of smoother surface characteristics and moisture wicking characteristics.

It is the primary object of the present invention to provide top sheets, bottom sheets, and pillow cases (and a method of producing the same) having good hand and surface characteristics, good strength, and numerous other advantages. This and other objects of the invention will become clear from an inspection of the detailed description of the invention and from the appended claims.

BRIEF DESCRIPTION OF THE DRAWINGS

FIG. 4 is a side schematic view of exemplary apparatus for producing a sheath/core yarn which is utilized in the construction of the products of FIGS. 1 through 3;

FIGS. 5 and 6 are schematic cross-sectional views of a sliver and roving prior to drafting, and the final composite roving after drafting, respectively, which are produced during the production of sheath/core yarn which is utilized in the practice of the invention; and FIG. 7 is a drawing simulating an enlargement of a photomicrograph of a yarn utilized in the production of sheeting products according to the invention, with polyester fibers in the core and cotton fibers in the sheath.

DETAILED DESCRIPTION OF THE DRAWINGS

Figure 1:
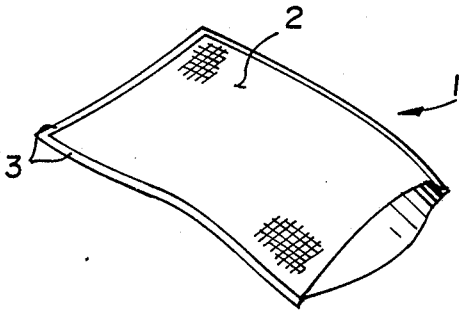
FIG. 1 is a perspective view of an exemplary pillow case according to the present invention.

An exemplary pillow case that may be produced according to the present invention is illustrated by reference numeral 1 in FIG. 1, having a fabric body 2, and having sewn edges 3. An exemplary top sheet according to the invention is illustrated by reference numeral 4 in FIG. 2, having a main fabric body 5 and having sewn folded over edging 6, if desired. An exemplary bottom (fitted contour) bedsheet according to the invention is shown at 7 in FIG. 3, having a main fabric body 8, and seams 9.

Figure 2:
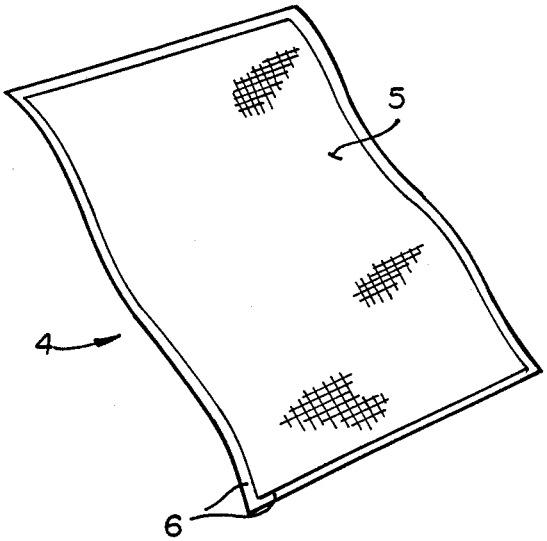
FIG. 2 is a perspective view of an exemplary top bedsheet according to the present invention.
Figure 3:
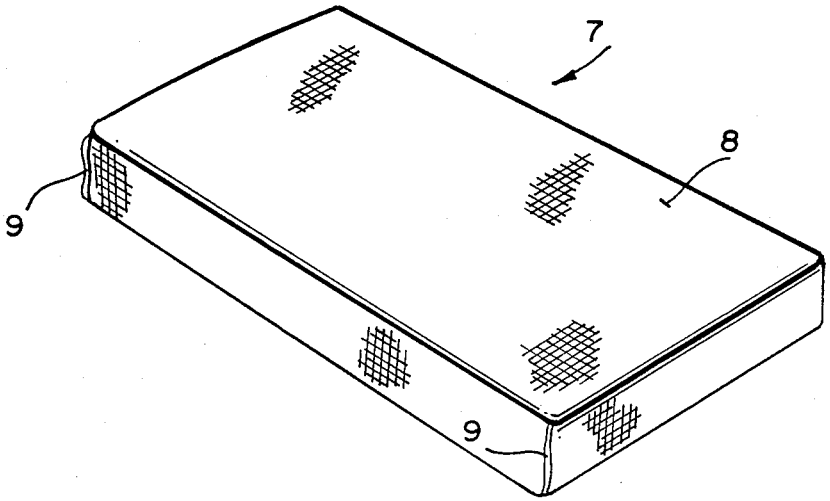
FIG. 3 is a perspective view of a typical bottom (fitted contour) bedsheet according to the present invention.

The fabric forming the bodies 2, 5, and 8 of the sheeting products according to the invention which are illustrated in FIGS. 1 through 3 is produced, according to the present invention, from a sheath/core yarn. The sheath/core yarn has a configuration illustrated schematically at 42 in FIG. 7. As is readily apparent from an inspection of FIG. 7, the core 40 which comprises fibers 43 is extremely cohesive, while the sheath 41, comprising amoeba-shaped fibers 44, completely covers the core 40 with little intermixing between the core and the sheath.

The sheath fibers 44, in the yarn 42 according to the invention, preferably comprise short staple fibers. Cotton, or cellulosic fibers having smoothness of hand properties comparable to cotton (when produced into a fabric) are the preferred fibers, particularly cotton. The fibers 44 actually illustrated in FIG. 7 are cotton.

The core fibers 43 for the yarn 42 used in the production of products according to the invention, have distinctly different properties from the sheath fibers 44. The core fibers 43 preferably are long staple synthetic fibers, particularly polyester or other synthetic polymer fibers having strength, wicking, and like properties comparable to those of polyester. Polyester fibers are illustrated in the drawing in FIG. 7.

The core 40 is completely covered by the sheath 41 in the yarn 42, as can be readily illustrated by producing the core and sheath of differently colored fibers. The sheath fibers comprise more than 50 percent of the yarn fibers, and preferably comprise between about 68–83 percent.

The yarn 42 is made into the sheeting products 1, 4, 7 according to the invention preferably by circular knitting the yarn into a fabric on a conventional circular knit machine. A jersey knit configuration is preferred. Such knitting can be practiced on a Monarch knitting machine, Model RL4 with 2520 needles in a circumference of 94 inches.

The fabric 2, 5, 8 according to the invention may have a weight depending upon the particular market to which it is directed. However, preferably the weight is approximately four ounces per square yard utilizing a yarn count of thirty two singles (32/1). Also, after production of the knit fabric 2, 5, 8, it is preferably finished utilizing a conventional compressive shrinking machine, to give a relaxed shrinkage of approximately five percent in both the length and the width dimensions.

Exemplary apparatus for producing the yarn 42 according to the invention is illustrated schematically in FIG. 4. The apparatus is more fully described in said co-pending application Ser. No. 824,788 filed Jan. 31, 1986. The apparatus includes sliver can 10 from which a sliver 11 of first fibers (to become the sheath) is drawn, a drafting apparatus 12 which comprises a pair of rear rolls 13, a pair of front rolls 14, and an apron 15 intermediate the rolls 13, 14, and a roving spinning frame 16. In addition, there is provided a supply 18 of a roving of second fibers (to become the core), which have distinctly different properties than the first fibers. For instance, the sliver 11 can be of cotton or like short staple fibers, while the roving 19 from roving supply 18 is of polyester or like synthetic long staple fibers. A trumpet 20 is disposed between the supplies 10, 18 and the rolls 13. The roving 22 which is produced has a distinct sheath and core arrangement, and to make the roving 22 into yarn one passes it through a conventional second draft stage 24 and then to a yarn spinning frame 25 for ring spinning the roving into yarn 42. The drafting apparatus 12 typically would apply a draft ratio of about 10-1, while the second draft apparatus 24 would typically apply a draft ratio of about 6-1.

In order to ensure good cohesiveness of the core of the composite roving being produced, various properties thereof will be controlled. One way to control core cohesiveness is by controlling the twist imparted to the roving 19 (that is the twist that the roving 19 has when it is utilized in the apparatus of FIG. 4). The apparatus is operable to produce the desired yarn according to the present invention when the twist multiple of the roving 19 is anywhere within the range of about 0.25–1.25 turns per inch, however it is desired that the twist multiple of the roving 19 be within the range of about 0.25–0.8 turns per inch, and preferably within the range of about 0.5–0.75. Another way to control core cohesiveness is by controlling the relative frictional properties of the fibers of the roving 19 and the sliver 11 (see FIG. 5). For instance the roving 19 can be treated with finish so that the fibers thereof have higher friction than the fibers of the sliver 11. Where the fibers of the roving 19 naturally have higher frictional properties (such as when the roving 19 is polyester and the sliver 11 is cotton), such finishing may not be necessary, but may be desirable even under such circumstances in order to properly and precisely control the core cohesion. Another way of controlling core cohesion is to make sure that the roving 19 is placed at the exact center line of the sliver 11, and maintaining a slight tension as by utilizing the trumpet 20 heretofore described.

The sliver 11 preferably has a flat configuration (see FIG. 5) when it exits trumpet 20, having about a 3 to 1 width to height ratio.

The roving 22 is illustrated schematically in FIG. 6, having a core 40 that is cohesive and essentially completely distinct from the sheath 41, the sheath 41 completely covering the core, and the core 40 comprising the second fibers and the sheath 41 comprising the first fibers.

It will thus be seen that according to the present invention advantageous sheeting products are produced. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods and products.

What is claimed is:

1. A method of producing a sheeting product comprising the steps of:

(a) providing a yarn having a sheath and core configuration with the sheath completely covering the core and comprising between about 68–83 percent of the yarn, the sheath fibers comprising cotton and the core fibers comprising staple polyester fibers;

said yarn formed by utilizing a drafting apparatus comprising front and back rollers, with an apron therebetween, and by:

(i) feeding a sliver of sheath fibers, and a roving of core fibers, to the drafting apparatus so that the roving of core fibers is at the center line of, and on top of, the sliver of sheath fibers, wherein the roving of core fibers is a roving having a twist multiple of about 0.25–0.8 turns per inch;

(ii) passing the roving and sliver together through the rear rolls, apron, and front rolls of the drafting apparatus to produce a drafted composite sliver; and (iii) mechanically imparting a twist to the drafted composite sliver to produce a composite roving having a core and a sheath covering the core;

(iv) drafting and spinning the composite roving to produce the yarn;

(b) circular knitting the yarn into a fabric; and (c) forming the fabric into a sheeting product.

2. A method as recited in claim 1 wherein step (b) is practiced by circular knitting the yarn into a jersey knit configuration.

3. A method as recited in claim 2 wherein steps (a) and (b) are practiced to produce a fabric having a weight of approximately 4 ounces per square yard.

4. A method as recited in claim 2 comprising the further step, between steps (b) and (c), of finishing the knit fabric utilizing a compressive shrinkage machine to provide a relaxed shrinkage of approximately five percent in both length and width dimensions.

5. A method of producing a sheeting product utilizing a drafting apparatus comprising front and back rollers with an apron therebetween and comprising the steps of:

(a) producing a yarn having a sheath and core configuration by:

(i) feeding a sliver of short staple fibers having, when made into a fabric, smoothness of hand, and a roving of second fibers comprising long staple fibers, to the drafting apparatus so that the roving of second fibers is at the centerline of, and on top of, the sliver of first fibers, said roving of second fibers having a twist multiple of about 0.25–0.8 turns per inch;

(ii) passing the roving and sliver together through the trumpet placing the roving on the exact centerline of the sliver to facilitate maintaining core cohesiveness, the sliver having a substantially 3-1 ratio of sliver width to height at the point where the sliver exits the trumpet;

(iii) after the roving and sliver exit the trumpet, passing the roving and sliver together through the rear rolls, apron, and front rolls of the drafting apparatus to produce a drafted composite sliver;

(iv) mechanically imparting a twist to the drafted composite sliver to produce a composite roving having a core and sheath, the sheath completely covering the core; and (v) drafting and spinning the composite roving to produce the yarn;

(b) circular knitting the yarn into a fabric; and (c) forming the fabric into a sheeting product.

6. A method of producing a sheeting product comprising the steps of:

(a) providing a yarn having a sheath and core configuration with the sheath completely covering the core and comprising more than 50 percent of the yarn, the sheath fibers selected from the group consisting of cotton and cellulosic fibers comparable to cotton in smoothness of hand, and the core fibers comprising staple fibers selected from the group cosisting of polyester and synthetic polymer fibers comparable to polyester in strength, softness and wicking properties;

said yarn formed by utilizing a drafting apparatus comprising front and back rollers, with an apron therebetween, and by:

(i) feeding a sliver of sheath fibers, and a roving of core fibers, to the drafting apparatus so that the roving of core fibers is at the center line of, and on top of, the sliver of sheath fibers, wherein the roving of core fibers is a roving having a twist multiple of about 0.25–0.8 turns per inch;

(ii) passing the roving and sliver together through the rear rolls, apron, and front rolls of the drafting apparatus to produce a drafted composite sliver;

(iii) mechanically imparting a twist to the drafted composite sliver to produce a composite roving having a core and a sheath covering the core; and (iv) drafting and spinning the composite roving to produce the yarn;

(b) circular knitting the yarn into a fabric; and (c) forming the fabric into a sheeting product.

7. A method as recited in claim 6 wherein step (b) is practiced by circular knitting the yarn into a jersey knit configuration.

8. A method as recited in claim 6 wherein steps (a) and (b) are practiced to produce a fabric having a weight of approximately 4 ounces per square yard.

9. A method as recited in claim 6 comprising the further step, between steps (b) and (c) of finishing the knit fabric utilizing a compressive shrinkage machine to provide a relaxed shrinkage of approximately five percent in both the length and width dimensions.

* * * * *